US008652597B2

(12) United States Patent
Hermans et al.

(10) Patent No.: US 8,652,597 B2
(45) **Date of Patent: *Feb. 18, 2014**

(54) HIGH BULK ROLLED TISSUE PRODUCTS

(71) Applicant: Kimberly-Clark Worldwide, Inc., Neenah, WI (US)

(72) Inventors: Michael Alan Hermans, Neenah, WI (US); Samuel August Nelson, Appleton, WI (US); Paulin Pawar, Appleton, WI (US); Frank Stephen Hada, Appleton, WI (US); Robert Eugene Krautkramer, Combined Locks, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/912,553

(22) Filed: Jun. 7, 2013

(65) Prior Publication Data

US 2013/0269892 A1 Oct. 17, 2013

Related U.S. Application Data

(63) Continuation of application No. 13/238,855, filed on Sep. 21, 2011, now Pat. No. 8,481,133.

(51) Int. Cl.

| | |
|---|---|
| ***B29D 22/00*** | (2006.01) |
| ***B29D 23/00*** | (2006.01) |
| ***B32B 1/08*** | (2006.01) |
| ***B23B 27/10*** | (2006.01) |

(52) U.S. Cl.
USPC ..... 428/34.2; 428/153; 428/154; 428/537.5

(58) Field of Classification Search
USPC ..... 428/34.2, 153, 154, 537.5; 162/118, 162/123
See application file for complete search history.

(56) References Cited

U.S. PATENT DOCUMENTS

| | | | |
|---|---|---|---|
| 4,440,597 | A | 4/1984 | Wells et al. |
| 5,607,551 | A | 3/1997 | Farrington, Jr. et al. |
| 5,672,248 | A | 9/1997 | Wendt et al. |
| 5,702,571 | A | 12/1997 | Kamps et al. |
| 6,077,590 | A | 6/2000 | Archer et al. |
| 6,440,268 | B1 | 8/2002 | Baggot et al. |
| 6,733,608 | B1 | 5/2004 | Baggot et al. |
| 6,893,535 | B2 | 5/2005 | Hermans et al. |
| 7,611,607 | B2 | 11/2009 | Mullally et al. |
| 2005/0136222 | A1 | 6/2005 | Hada et al. |
| 2009/0188636 | A1 | 7/2009 | Salaam et al. |
| 2011/0027563 | A1 | 2/2011 | Manifold et al. |
| 2013/0068868 | A1 | 3/2013 | Hermans et al. |

FOREIGN PATENT DOCUMENTS

| | | | |
|---|---|---|---|
| EP | 1 004 703 | A1 | 5/2000 |
| EP | 0 806 520 | B1 | 11/2002 |

*Primary Examiner* — Michael C Miggins
(74) *Attorney, Agent, or Firm* — Kimberly-Clark Worldwide, Inc.

(57) ABSTRACT

Spirally wound paper products are disclosed having desirable roll bulk, firmness and softness properties. The rolled products can be made from a multiple ply tissue webs formed according to various processes. Tissue webs having basis weights greater than about 40 grams per square meter were wound into rolls having a Kershaw roll firmness of less than about 9 mm and a roll bulk of greater than about 15 cc/g. Similarly, tissue webs having basis weights less than about 40 grams per square meter were wound into rolls having a Kershaw roll firmness of less than about 9 mm and a roll bulk of greater than about 18 cc/g.

20 Claims, 2 Drawing Sheets

HIGH BULK ROLLED TISSUE PRODUCTS

BACKGROUND

For rolled tissue products, such as bathroom tissue and paper towels, consumers generally prefer firm rolls having a large diameter. A firm roll conveys superior product quality and a large diameter conveys sufficient material to provide value for the consumer. From the standpoint of the tissue manufacturer, however, providing a firm roll having a large diameter is a challenge. In order to provide a large diameter roll, while maintaining an acceptable cost of manufacture, the tissue manufacturer must produce a finished tissue roll having higher roll bulk. One means of increasing roll bulk is to wind the tissue roll loosely. Loosely wound rolls however, have low firmness and are easily deformed, which makes them unappealing to consumers. As such, there is a need for tissue rolls having high bulk as well as good firmness. Furthermore, it is desirable to provide a rolled tissue product having a high-basis-weight tissue sheet that provides greater absorbency and hand protection in use.

Although it is desirable to provide a sheet having high-basis-weight, bulk and good roll firmness, improvement of one of these properties typically comes at the expense of another. For example, as the basis weight of the tissue sheets is increased, achieving high roll bulk becomes more challenging since much of the bulk of the tissue structure is achieved by molding of the embryonic tissue web into the paper-making fabric and this bulk is decreased by increasing the basis weight of the sheet.

Finally, In addition to the high roll bulk and good roll firmness, consumers also often prefer multi-ply tissue for the softness and absorbency characteristics inherent to multi-ply tissue structures. Hence the tissue manufacturer must strive to economically produce a tissue roll that meets these often-contradictory parameters of large diameter, good firmness, high quality sheets and acceptable cost.

SUMMARY

Accordingly, in one embodiment, the present disclosure provides rolled tissue product comprising a multi-ply tissue web spirally wound into a roll, the wound roll having a Kershaw roll firmness of less than about 9 mm and a roll bulk of greater than about 15 cc/g, the tissue web having a basis weight of greater than about 40 gsm.

In another embodiment, the present disclosure provides rolled tissue product comprising an through-air dried multi-ply tissue web spirally wound into a roll, the wound roll having a Kershaw roll firmness of less than about 9 mm and a roll bulk of greater than about 15 cc/g, the tissue web having a basis weight of greater than about 40 gsm, a Burst Strength greater than about 1000 grams and a geometric mean tensile strength from about 900 to about 1300 g/3 inches.

In still other embodiments, the present disclosure provides a rolled tissue product comprising a multi-ply tissue web spirally wound into a roll, the wound roll having a Kershaw roll firmness of less than about 9 mm and a roll bulk of greater than about 18 cc/g, the tissue web having a basis weight less than about 40 gsm.

In other embodiments, the present disclosure provides a rolled tissue product comprising a multi-ply tissue web spirally wound into a roll, the wound roll having a Kershaw roll firmness of less than about 10 mm and a roll bulk of greater than about 18 cc/g, the multi-ply tissue web having a first and a second surface, the first surface having a Surface Smoothness from about 0.15 to about 0.25 MIU, wherein the web has a basis weight less than about 50 gsm.

In yet other embodiments, the present disclosure provides a rolled tissue product comprising a multi-ply tissue web spirally wound into a roll, the wound roll having a Kershaw roll firmness of less than about 5 mm and a roll bulk of greater than about 10 cc/g, the multi-ply tissue web having a first and a second surface, the first surface having a Surface Smoothness greater than about 0.15 MIU, wherein the web has a basis weight greater than about 40 gsm.

In still other embodiments, the present disclosure provides a rolled tissue product comprising a multi-ply tissue web spirally wound into a roll, the wound roll having a Kershaw roll firmness of less than about 5 mm and a roll bulk of greater than about 10 cc/g, the multi-ply tissue web having a Shear Hysteresis of less than about 3.50 gf/cm.

DEFINITIONS

Figure 1:
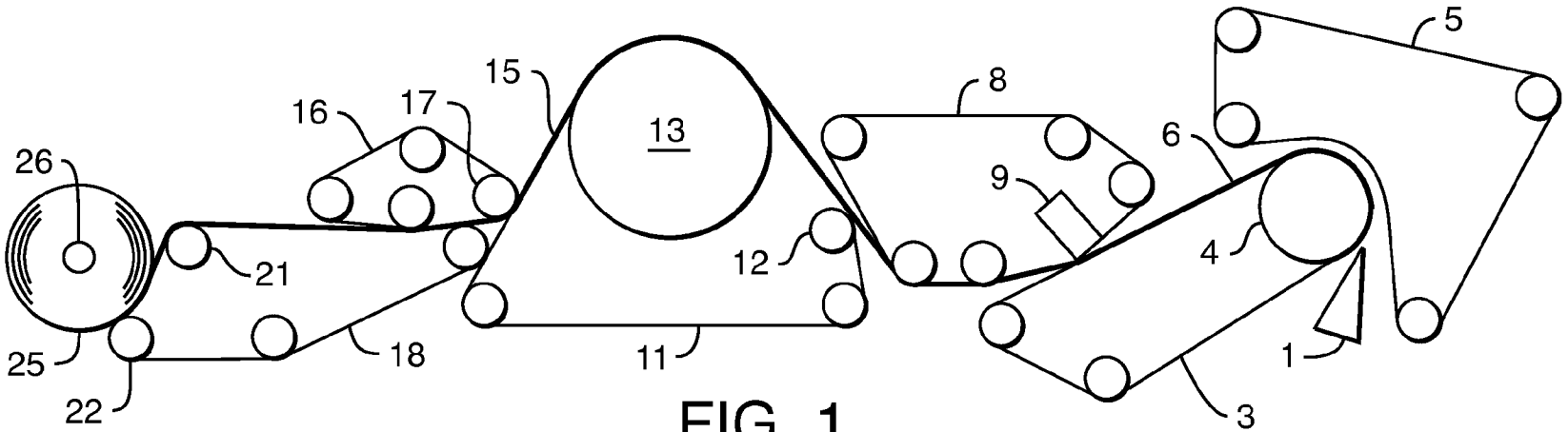
FIG. 1 is a schematic diagram of one embodiment of a process for forming an uncreped through-dried tissue web for use in the present disclosure.

As used herein, the term "tissue product" refers to products made from base webs comprising fibers and includes, bath tissues, facial tissues, paper towels, industrial wipers, food-service wipers, napkins, medical pads, and other similar products.

As used herein, the terms "tissue web" or "tissue sheet" refer to a cellulosic web suitable for making or use as a facial tissue, bath tissue, paper towels, napkins, or the like. It can be layered or unlayered, creped or uncreped, and can consist of a single ply or multiple plies. The tissue webs referred to above are preferably made from natural cellulosic fiber sources such as hardwoods, softwoods, and nonwoody species, but can also contain significant amounts of recycled fibers, sized or chemically-modified fibers, or synthetic fibers.

As used herein, the term "Roll Bulk" refers to the volume of paper divided by its mass on the wound roll. Roll Bulk is calculated by multiplying pi (3.142) by the quantity obtained by calculating the difference of the roll diameter squared in cm squared ($cm^2$) and the outer core diameter squared in cm squared ($cm^2$) divided by 4, divided by the quantity sheet length in cm multiplied by the sheet count multiplied by the bone dry Basis Weight of the sheet in grams (g) per cm squared ($cm^2$).

As used herein, the "Geometric mean tensile strength" and "GMT" refer to the square root of the product of the machine direction tensile strength and the cross-machine direction tensile strength of the web. As used herein, tensile strength refers to mean tensile strength as would be apparent to one skilled on the art. Geometric tensile strengths are measured using an MTS Synergy tensile tester using a 3 inch sample width, a jaw span of 2 inches, and a crosshead speed of 10 inches per minute after maintaining the sample under TAPPI conditions for 4 hours before testing. A 50 Newton maximum load cell is utilized in the tensile test instrument.

Test Methods

KES Surface Test

The surface properties of samples were measured on KES Surface Tester (Model KE-SE, Kato Techo Co., Ltd., 26 Karato-cho, Nisikujo, Minami-ku, Kyoto, Japan). In each case, the measurements were performed according to the Kawabata Test Procedures with samples tested along MD and CD and on both sides for 5 repeats with a sample size of 10 cm×10 cm. Care was taken to avoid folding, wrinkling, stressing, or otherwise handling the samples in a way that would deform the sample. Samples were tested using a multi-wire probe of 10 mm×10 mm consisting of 20 piano wires of 0.5 mm in diameter each with a contact force of 25 grams. The test speed was set at 1 mm/s. The sensor was set at "H" and FRIC was set at "DT". The data was acquired using KES-FB System Measurement Program KES-FB System Ver 7.09 E for Win98/2000/XP by Kato tech Co., Ltd. The selection in the program was "KES-SE Friction Measurement".

KES Surface Tester determined the Surface Smoothness (MIU) and Mean deviation of MIU (MMD), where higher values of MIU indicate more drag on the sample surface and higher values of MMD indicate more variation or less uniformity on the sample surface.

The values Surface Smoothness (MIU) and Mean deviation of MIU (MMD) are defined by:

$$MIU(\bar{\mu})=1/X\int_0^x \mu dx$$

$$MMD=1/X\int_0^x |\mu-\bar{\mu}|dx$$

where $\mu$=friction force divided by compression force $\bar{\mu}$=mean value of $\mu$ x=displacement of the probe on the surface of specimen, cm X=maximum travel used in the calculation, 2 cm KES Shear Test The KES Shear Test is designed to evaluate the amount of deformation when shear force is applied to the X-Y plane of the material on model KES-FB1Tensile & Shear Tester (Kato Tech Co., Ltd., 26 Karato-cho, Nisikujo, Minami-ku, Kyoto, Japan). The material is subjected to parallel shear forces under a constant tensile force of 100 grams with a shear strain rate of 0.417 mm/s. The maximum shearing angle was set at 2°. The sensor was set at "2×5". The data was acquired using KES-FB System Measurement Program KES-FB System Ver 7.09 E for Win98/2000/XP by Kato tech Co., Ltd. The selection in the program was "FB1-Optional Condition: Shear".

The samples were tested along MD and CD for 5 repeats with a sample size of 10 cm×10 cm. The KES Shear Test yields two values: (1) Shear Rigidity (G), which is expressed in gf/cm degree, and (2) Shear Hysteresis (2HG), which is expressed in gf/cm. Shear Rigidity represents the shear rigidity or stiffness of a material and it is the slope of the shear curve between 0.5° and 1.5° shear angles. The larger the G value, the more resistant the material is to the shear deformation. Shear Hysteresis represents the ability of a material to recover after the release of shear forces. It is the width of the shear curves at 0.5° shear angle. The larger the 2HG value, the less ability a material has to recover.

Kershaw Firmness

Kershaw Firmness was measured using the Kershaw Test as described in detail in U.S. Pat. No. 6,077,590, which is incorporated herein by reference in a manner consistent with the present disclosure. The apparatus is available from Kershaw Instrumentation, Inc. (Swedesboro, N.J.) and is known as a Model RDT-2002 Roll Density Tester.

Absorbency

Absorbency is measured as described in U.S. Pat. No. 7,828,932, which is incorporated herein in a manner consistent with the present disclosure. The test method utilizes a modified Gravimetric Absorbency Tester (GAT), which is commercially available from the M/K Systems, Inc. (Peabody, Mass.). In the conventional absorbency measurements, GATs uses the flat and flat plate configuration which is likely to induce the channeling of water between the plate and the sample, which may result in an erroneous result. To eliminate this error, a recessed-recessed plate configuration was used to determine Absorbency, as U.S. Pat. No. 7,828,932. Using the modified GAT, the majority of the sample area does not come in contact with solid surfaces. Non-contact between the sample and any solid surface prevents over-saturation, excess fluid flow, and surface wicking; thereby eliminating artificial effects.

The sample comprises a 2.5 cm radius circular specimen die-cut from a single sheet of product. The sample is placed on a plate that is recessed throughout the sample area, with the exception of the specimen's outer edge and a small "stub" in the center containing a port leading from a fluid reservoir. A top recessed plate, symmetrical to the bottom recessed plate, is placed onto the outer edge of the specimen to hold it in place. The sample sits just above the reservoir fluid level, which is kept constant between tests. To start the test, the plate is moved automatically downward just far enough to force a small amount of fluid through the port, out of the plate stub, and in contact with the sample. The bottom recessed plate returns to its original position immediately, but capillary tension has been established within the sample and fluid will continue to wick radially. To prevent forces other than the absorbent forces from influencing the test, the sample level is automatically adjusted. Non-contact between the sample and any solid surface prevents over-saturation, excess fluid flow, and surface wicking; thereby eliminating artificial effects. Data are recorded, at a data collection speed of five readings per second, as grams of fluid flow from the reservoir to the sample with respect to time. From this data, the speed of intake and the amount of water absorbed by the sample at any given time are determined.

DETAILED DESCRIPTION

In general, the present disclosure is directed towards spirally-wound multi-ply tissue products and methods of producing the same. The spirally-wound products comprise tissue webs prepared according to the present disclosure. Generally the products of the present disclosure may comprise either low or high basis weight tissue webs, depending on the product attributes desired by the consumer. For example, in certain embodiments rolled tissue products prepared according to the present disclosure may comprise low basis weight webs, wherein the webs have a basis weight less than about 40 grams per square meter ("gsm"), for example from about 30 to about 40 gsm and more specifically from about 35 to about 38 gsm. In other embodiments the products may comprise high basis weight webs, wherein the webs have a basis weight greater than about 40 gsm, for example from about 40 to about 50 gsm, and more specially from about 42 to about 45 gsm.

The spirally-wound products have a unique combination of properties that represent various improvements over prior art products. For instance, rolled products prepared according to the present disclosure may have improved roll firmness and bulk, while still maintaining sheet softness and strength properties.

In certain embodiments, rolled products made according to the present disclosure may comprise a spirally-wound multi-ply tissue web having a basis weight greater than about 40 gsm, wherein the rolled product has a Kershaw roll firmness of less than about 7 mm, such as less than about 6.5 mm. In one particular embodiment, for instance, a spirally-wound multi-ply tissue web having a basis weight greater than about 40 gsm may have a Kershaw roll firmness less than about 6.5 mm, such as less than about 6 mm. Within the above-roll firmness ranges, rolls made according to the present disclosure do not appear to be overly soft and "mushy" as may be undesirable by some consumers during some applications.

In the past, at the above-roll firmness levels, multi-ply spirally wound tissue products had a tendency to have low roll bulks and/or poor sheet softness properties. However, it has now been discovered that multi-ply webs having basis weights greater than about 40 gsm, preferably from about 40 to about 45 gsm, can be produced such that the webs can maintain a roll bulk of at least 12 cc/g, such as from about 12 to about 20 cc/g, even when spirally wound under tension. For instance, spirally wound products comprising a multi-ply tissue web having a basis weight greater than about 40 gsm may have a roll bulk of about 15 cc/g while still maintaining superior sheet softness and strength.

The present disclosure also provides spirally wound tissue products comprising multi-ply tissue webs having low basis weight such as, for example, less than about 40 gsm, preferably from about 35 to about 40 gsm and more preferably about 38 gsm. Spirally wound tissue products comprising lower basis weight tissue webs possess improved properties over prior art products, particularly in terms of roll bulk and firmness. In certain embodiments spirally wound tissue products comprising multi-ply tissue webs having a basis weight less than about 40 gsm, have a Kershaw roll firmness of less than about 9 mm and a roll bulk of greater than about 12 cc/g. In a particularly preferred embodiment spirally wound products comprising low basis weight webs, i.e., webs less than about 40 gsm, have a Kershaw roll firmness from about 5 to about 7 mm and a roll bulk from about 12 to about 15 cc/g.

In still other embodiments, the present disclosure provides through-air dried basesheets having enhanced strength and durability, such as improved geometric mean tensile (GMT), cross machine direction stretch (CDS) and dry burst strength. For example, tissue webs prepared according to the present disclosure may have a GMT greater than about 900 g/3 inches, such as from about 900 to about 1500 g/3 inches, and more preferably from about 1000 to about 1200 g/3 inches. Similarly, tissue webs prepared according to the present disclosure may have a percent CDS of at least about 8 percent, such as from about 10 to about 15 percent and more preferably from about 12 to about 15 percent. While in other instances, tissue webs prepared according to the present disclosure may have a dry burst strength greater than about 600 g, such as from about 700 to about 1200 g and more preferably from about 800 to about 1000 g.

In certain instances, the strength and durability of the tissue web may be dependent on the basis weight of the web. For example, in certain instances, the disclosure provides multi-ply tissue webs having a basis weight greater than about 40 gsm, wherein the webs have a GMT from about 500 to about 1500 g/3 inches, and more preferably from about 700 to about 1000 g/3 inches and dry burst strength from about 400 to about 1600 g, and more preferably from about 600 to about 1200 g. In other instances, webs prepared according to the present disclosure having a basis weight less than about 40 gsm, may have a GMT from about 500 to about 1500 g/3 inches, and more preferably from about 700 to about 1000 g/3 inches and dry burst strength from about 400 to about 1600 g, and more preferably from about 600 to about 1200 g.

In other embodiments, webs prepared according to the present disclosure have improved surface properties including, for example, Coefficient of friction (MIU), Mean deviation of MIU (MMD), Shear Rigidity (G), and Shear Hysteresis (2HG).

Improved Shear Hysteresis is of particular significance to the consumer because tissue products, such as those prepared according to the present disclosure, should have a moderate degree of resistance to losing their shape while in use. If a tissue product has too much shear resistance it may not conform to the user's body in use and perform poorly, while too little shear resistance may result in a weak and limp sheet with little integrity. Further, after initial use it may be desirable for a tissue sheet to have some degree of ability to return to its original shape as opposed to being deformed into a tightly-compressed ball of material. For example, after one wipe with a tissue, the user may wish to repeat the wiping motion to remove additional material, for example body fluids in the case of bathroom tissue or liquids for a paper towel. A low shear hysteresis value is indicative of a high ability to recover after the release of the shear forces inherent to consumer use. Accordingly, in one embodiment the present disclosure provides tissue webs having a Shear Hysteresis of less than about 3.5 gf/cm, such as from about 2.5 to about 3.2 gf/cm.

Base webs useful in preparing spirally wound tissue products according to the present disclosure can vary depending upon the particular application. In general, the webs can be made from any suitable type of fiber. For instance, the base web can be made from pulp fibers, other natural fibers, synthetic fibers, and the like. Suitable cellulosic fibers for use in connection with this invention include secondary (recycled) papermaking fibers and virgin papermaking fibers in all proportions. Such fibers include, without limitation, hardwood and softwood fibers as well as nonwoody fibers. Noncellulosic synthetic fibers can also be included as a portion of the furnish. It has been found that a high quality product having a unique balance of properties may be made using predominantly secondary fibers or all secondary fibers.

Tissue webs made in accordance with the present disclosure can be made with a homogeneous fiber furnish or can be formed from a stratified fiber furnish producing layers within the single- or multi-ply product. Stratified base webs can be formed using equipment known in the art, such as a multi-layered headbox. Both strength and softness of the base web can be adjusted as desired through layered tissues, such as those produced from stratified headboxes.

For instance, different fiber furnishes can be used in each layer in order to create a layer with the desired characteristics. For example, layers containing softwood fibers have higher tensile strengths than layers containing hardwood fibers. Hardwood fibers, on the other hand, can increase the softness of the web. In one embodiment, the single ply base web of the present disclosure includes a first outer layer and a second outer layer containing primarily hardwood fibers. The hardwood fibers can be mixed, if desired, with paper broke in an amount up to about 10 percent by weight and/or softwood fibers in an amount up to about 10 percent by weight. The base web further includes a middle layer positioned in between the first outer layer and the second outer layer. The middle layer can contain primarily softwood fibers. If desired, other fibers, such as high-yield fibers or synthetic fibers may be mixed with the softwood fibers in an amount up to about 10 percent by weight.

When constructing a web from a stratified fiber furnish, the relative weight of each layer can vary depending upon the particular application. For example, in one embodiment, when constructing a web containing three layers, each layer can be from about 15 to about 40 percent of the total weight of the web, such as from about 25 to about 35 percent of the weight of the web.

Wet strength resins may be added to the furnish as desired to increase the wet strength of the final product. Presently, the most commonly used wet strength resins belong to the class of polymers termed polyamide-polyamine epichlorohydrin resins. There are many commercial suppliers of these types of resins including Hercules, Inc. (Kymene™) Henkel Corp. (Fibrabond™), Borden Chemical (Cascamide™), Georgia-Pacific Corp. and others. These polymers are characterized by having a polyamide backbone containing reactive crosslinking groups distributed along the backbone. Other useful wet strength agents are marketed by American Cyanamid under the Parez™ trade name.

Similarly, dry strength resins can be added to the furnish as desired to increase the dry strength of the final product. Such dry strength resins include, but are not limited to carboxymethyl celluloses (CMC), any type of starch, starch derivatives, gums, polyacrylamide resins, and others as are well known. Commercial suppliers of such resins are the same those that supply the wet strength resins discussed above.

Another strength chemical that can be added to the furnish is Baystrength 3000 available from Kemira (Atlanta, Ga.), which is a glyoxalated cationic polyacrylamide used for imparting dry and temporary wet tensile strength to tissue webs.

As described above, the tissue product of the present disclosure can generally be formed by any of a variety of papermaking processes known in the art. Preferably the tissue web is formed by a through-air drying and be either creped or uncreped. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554 all of which are incorporated herein in a manner consistent with the present disclosure. When forming multi-ply tissue products, the separate plies can be made from the same process or from different processes as desired.

For example, in one embodiment, tissue webs may be creped through-air dried webs formed using processes known in the art. To form such webs, an endless traveling forming fabric, suitably supported and driven by rolls, receives the layered papermaking stock issuing from the headbox. A vacuum box is disposed beneath the forming fabric and is adapted to remove water from the fiber furnish to assist in forming a web. From forming fabric, a formed web is transferred to a second fabric, which may be either a wire or a felt. The fabric is supported for movement around a continuous path by a plurality of guide rolls. A pick up roll designed to facilitate transfer of web from fabric to fabric may be included to transfer the web.

Preferably the formed web is dried by transfer to the surface of a rotatable heated dryer drum, such as a Yankee dryer. The web may be transferred to the Yankee directly from the throughdrying fabric, or preferably, transferred to an impression fabric which is then used to transfer the web to the Yankee dryer. In accordance with the present disclosure, the creping composition of the present disclosure may be applied topically to the tissue web while the web is traveling on the fabric or may be applied to the surface of the dryer drum for transfer onto one side of the tissue web. In this manner, the creping composition is used to adhere the tissue web to the dryer drum. In this embodiment, as the web is carried through a portion of the rotational path of the dryer surface, heat is imparted to the web causing most of the moisture contained within the web to be evaporated. The web is then removed from dryer drum by a creping blade. The creping web as it is formed further reduces internal bonding within the web and increases softness. Applying the creping composition to the web during creping, on the other hand, may increase the strength of the web.

In another embodiment the formed web is transferred to the surface of the rotatable heated dryer drum, which may be a Yankee dryer. The press roll may, in one embodiment, comprise a suction pressure roll. In order to adhere the web to the surface of the dryer drum, a creping adhesive may be applied to the surface of the dryer drum by a spraying device. The spraying device may emit a creping composition made in accordance with the present disclosure or may emit a conventional creping adhesive. The web is adhered to the surface of the dryer drum and then creped from the drum using the creping blade. If desired, the dryer drum may be associated with a hood. The hood may be used to force air against or through the web.

In other embodiments, once creped from the dryer drum, the web may be adhered to a second dryer drum. The second dryer drum may comprise, for instance, a heated drum surrounded by a hood. The drum may be heated from about 25 to about 200° C., such as from about 100 to about 150° C.

In order to adhere the web to the second dryer drum, a second spray device may emit an adhesive onto the surface of the dryer drum. In accordance with the present disclosure, for instance, the second spray device may emit a creping composition as described above. The creping composition not only assists in adhering the tissue web to the dryer drum, but also is transferred to the surface of the web as the web is creped from the dryer drum by the creping blade.

Once creped from the second dryer drum, the web may, optionally, be fed around a cooling reel drum and cooled prior to being wound on a reel.

In addition to applying the creping composition during formation of the fibrous web, the creping composition may also be used in post-forming processes. For example, in one aspect, the creping composition may be used during a print-creping process. Specifically, once topically applied to a fibrous web, the creping composition has been found well-suited to adhering the fibrous web to a creping surface, such as in a print-creping operation.

For example, once a fibrous web is formed and dried, in one aspect, the creping composition may be applied to at least one side of the web and the at least one side of the web may then be creped. In general, the creping composition may be applied to only one side of the web and only one side of the web may be creped, the creping composition may be applied to both sides of the web and only one side of the web is creped, or the creping composition may be applied to each side of the web and each side of the web may be creped.

Once creped the tissue web may be pulled through a drying station. The drying station can include any form of a heating unit, such as an oven energized by infra-red heat, microwave energy, hot air or the like. A drying station may be necessary in some applications to dry the web and/or cure the creping composition. Depending upon the creping composition selected, however, in other applications a drying station may not be needed.

In other embodiments, the base web is formed by an uncreped through-air drying process. Referring to FIG. 1, a process of carrying out using the present disclosure will be described in greater detail. The process shown depicts an uncreped through dried process, but it will be recognized that any known papermaking method or tissue making method can be used in conjunction with the nonwoven tissue making fabrics of the present disclosure. Related uncreped through-air dried tissue processes are described for example, in U.S. Pat. Nos. 5,656,132 and 6,017,417, both of which are hereby incorporated by reference herein in a manner consistent with the present disclosure.

In FIG. 1, a twin wire former having a papermaking headbox 10 injects or deposits a furnish of an aqueous suspension of papermaking fibers onto a plurality of forming fabrics, such as the outer forming fabric 5 and the inner forming fabric 3, thereby forming a wet tissue web 6. The forming process of the present disclosure may be any conventional forming process known in the papermaking industry. Such formation processes include, but are not limited to, Fourdriniers, roof formers such as suction breast roll formers, and gap formers such as twin wire formers and crescent formers.

The wet tissue web 6 forms on the inner forming fabric 3 as the inner forming fabric 3 revolves about a forming roll 4. The inner forming fabric 3 serves to support and carry the newly-formed wet tissue web 6 downstream in the process as the wet tissue web 6 is partially dewatered to a consistency of about 10 percent based on the dry weight of the fibers. Additional dewatering of the wet tissue web 6 may be carried out by known paper making techniques, such as vacuum suction boxes, while the inner forming fabric 3 supports the wet tissue web 6. The wet tissue web 6 may be additionally dewatered to a consistency of at least about 20 percent, more specifically between about 20 to about 40 percent, and more specifically about 20 to about 30 percent.

The forming fabric 3 can generally be made from any suitable porous material, such as metal wires or polymeric filaments. For instance, some suitable fabrics can include, but are not limited to, Albany 84M and 94M available from Albany International (Albany, N.Y.) Asten 856, 866, 867, 892, 934, 939, 959, or 937; Asten Synweve Design 274, all of which are available from Asten Forming Fabrics, Inc. (Appleton, Wis.); and Voith 2164 available from Voith Fabrics (Appleton, Wis.). Forming fabrics or felts comprising nonwoven base layers may also be useful, including those of Scapa Corporation made with extruded polyurethane foam such as the Spectra Series.

The wet web 6 is then transferred from the forming fabric 3 to a transfer fabric 8 while at a solids consistency of between about 10 to about 35 percent, and particularly, between about 20 to about 30 percent. As used herein, a "transfer fabric" is a fabric that is positioned between the forming section and the drying section of the web manufacturing process.

Transfer to the transfer fabric 8 may be carried out with the assistance of positive and/or negative pressure. For example, in one embodiment, a vacuum shoe 9 can apply negative pressure such that the forming fabric 3 and the transfer fabric 8 simultaneously converge and diverge at the leading edge of the vacuum slot. Typically, the vacuum shoe 9 supplies pressure at levels between about 10 to about 25 inches of mercury. As stated above, the vacuum transfer shoe 9 (negative pressure) can be supplemented or replaced by the use of positive pressure from the opposite side of the web to blow the web onto the next fabric. In some embodiments, other vacuum shoes can also be used to assist in drawing the fibrous web 6 onto the surface of the transfer fabric 8.

Typically, the transfer fabric 8 travels at a slower speed than the forming fabric 3 to enhance the MD and CD stretch of the web, which generally refers to the stretch of a web in its cross (CD) or machine direction (MD) (expressed as percent elongation at sample failure). For example, the relative speed difference between the two fabrics can be from about 1 to about 30 percent, in some embodiments from about 5 to about 20 percent, and in some embodiments, from about 10 to about 15 percent. This is commonly referred to as "rush transfer". During "rush transfer", many of the bonds of the web are believed to be broken, thereby forcing the sheet to bend and fold into the depressions on the surface of the transfer fabric 8. Such molding to the contours of the surface of the transfer fabric 8 may increase the MD and CD stretch of the web. Rush transfer from one fabric to another can follow the principles taught in any one of the following patents, U.S. Pat. Nos. 5,667,636, 5,830,321, 4,440,597, 4,551,199, 4,849,054, all of which are hereby incorporated by reference herein in a manner consistent with the present disclosure.

The wet tissue web 6 is then transferred from the transfer fabric 8 to a throughdrying fabric 11. Typically, the transfer fabric 8 travels at approximately the same speed as the throughdrying fabric 11. However, it has now been discovered that a second rush transfer may be performed as the web is transferred from the transfer fabric 8 to a throughdrying fabric 11. This rush transfer is referred to herein as occurring at the second position and is achieved by operating the throughdrying fabric 11 at a slower speed than the transfer fabric 8. By performing rush transfer at two distinct locations, i.e., the first and the second positions, a tissue product having increased CD stretch may be produced.

In addition to rush transferring the wet tissue web from the transfer fabric 8 to the throughdrying fabric 11, the wet tissue web 6 may be macroscopically rearranged to conform to the surface of the throughdrying fabric 11 with the aid of a vacuum transfer roll 12 or a vacuum transfer shoe like vacuum shoe 9. If desired, the throughdrying fabric 11 can be run at a speed slower than the speed of the transfer fabric 8 to further enhance MD stretch of the resulting absorbent tissue product. The transfer may be carried out with vacuum assistance to ensure conformation of the wet tissue web 6 to the topography of the throughdrying fabric 11.

While supported by the throughdrying fabric 11, the wet tissue web 6 is dried to a final consistency of about 94 percent or greater by a throughdryer 13. The web 15 then passes through the winding nip between the reel drum 22 and the reel 26 and is wound into a roll of tissue 25 for subsequent converting, such as slitting cutting, folding, and packaging.

The web is transferred to the throughdrying fabric for final drying preferably with the assistance of vacuum to ensure macroscopic rearrangement of the web to give the desired bulk and appearance. The use of separate transfer and throughdrying fabrics can offer various advantages since it allows the two fabrics to be designed specifically to address key product requirements independently. For example, the transfer fabrics are generally optimized to allow efficient conversion of high rush transfer levels to high MD stretch while throughdrying fabrics are designed to deliver bulk and CD stretch. It is therefore useful to have moderately coarse and moderately three-dimensional transfer fabrics and throughdrying fabrics which are quite coarse and three dimensional in the optimized configuration. The result is that a relatively smooth sheet leaves the transfer section and then is macroscopically rearranged (with vacuum assist) to give the high bulk, high CD stretch surface topology of the throughdrying fabric. Sheet topology is completely changed from transfer to throughdrying fabric and fibers are macroscopically rearranged, including significant fiber-fiber movement.

The drying process can be any noncompressive drying method which tends to preserve the bulk or thickness of the wet web including, without limitation, throughdrying, infrared radiation, microwave drying, etc. Because of its commercial availability and practicality, throughdrying is well known and is one commonly used means for noncompressively drying the web for purposes of this invention. Suitable throughdrying fabrics include, without limitation, fabrics with substantially continuous machine direction ridges whereby the ridges are made up of multiple warp strands grouped together, such as those disclosed in U.S. Pat. No. 6,998,024. Other suitable throughdrying fabrics include those disclosed in U.S. Pat. No. 7,611,607, which is incorporated herein in a manner consistent with the present disclosure, particularly the fabrics denoted as Fred (t1207-77), Jetson (t1207-6) and Jack (t1207-12). The web is preferably dried to final dryness on the throughdrying fabric, without being pressed against the surface of a Yankee dryer, and without subsequent creping.

Once the wet tissue web 6 has been non-compressively dried, thereby forming the dried tissue web 15, it is possible to crepe the dried tissue web 15 by transferring the dried tissue web 15 to a Yankee dryer prior to reeling, or using alternative foreshortening methods such as microcreping as disclosed in U.S. Pat. No. 4,919,877.

In the wound product, it is often advantageous to wind the product with the softest side facing the consumer, and hence the shearing process to increase the softness of this side is preferred. However, it is also possible to treat the air side of the web rather than the fabric side, and in these embodiments, it would be possible to increase the air-side softness to a level higher than that of the fabric side.

The process of the present disclosure is well suited to forming multi-ply tissue products. The multi-ply tissue products can contain two plies, three plies, or a greater number of plies. In one particular embodiment, a two-ply rolled tissue product is formed according to the present disclosure in which both plies are manufactured using the same papermaking process, such as, for example, uncreped through-air dried. However, in other embodiments, the plies may be formed by two different processes. Generally, prior to being wound in a roll, the first ply and the second ply are attached together. Any suitable manner for laminating the webs together may be used. For example, the process includes a crimping device that causes the plies to mechanically attach together through fiber entanglement. In an alternative embodiment, however, an adhesive may be used in order to attach the plies together.

The following examples are intended to illustrate particular embodiments of the present disclosure without limiting the scope of the appended claims.

EXAMPLES

Base sheets were made using two throughdried papermaking processes, commonly referred to as "creped throughdried" ("CTAD") and "uncreped throughdried" ("UCTAD") respectively. In the first case the web was using a through-air dried tissue making process and creped after final drying (hereinafter referred to as "CTAD"). In the second case the web was produced without creping as generally described in U.S. Pat. No. 5,607,551 (hereinafter referred to as "UCTAD"). Base sheets with basis weights of 16, 18, 20, 22 and 24 grams per square meter ("gsm") were produced from each of the two processes, and various strength webs were produced at the different basis weights. The base sheets were then converted into 2-ply tissue webs and spirally wound into rolled tissue products.

In all cases the base webs were produced from a furnish comprising a blend of 50 percent northern softwood kraft and 50 percent eucalyptus. However, the product was produced using a layered headbox fed by three stock chests such that the product was made in 3 layers, each a 50/50 blend of softwood and eucalyptus fibers. Strength was controlled via the addition of Baystrength 3000 and/or by refining the furnish. Baystrength 3000 is a cationic glyoxalated polyacrylamide resin supplied by Kemira (Atlanta, Ga.) providing dry and temporary wet tensile strength.

Figure 2:
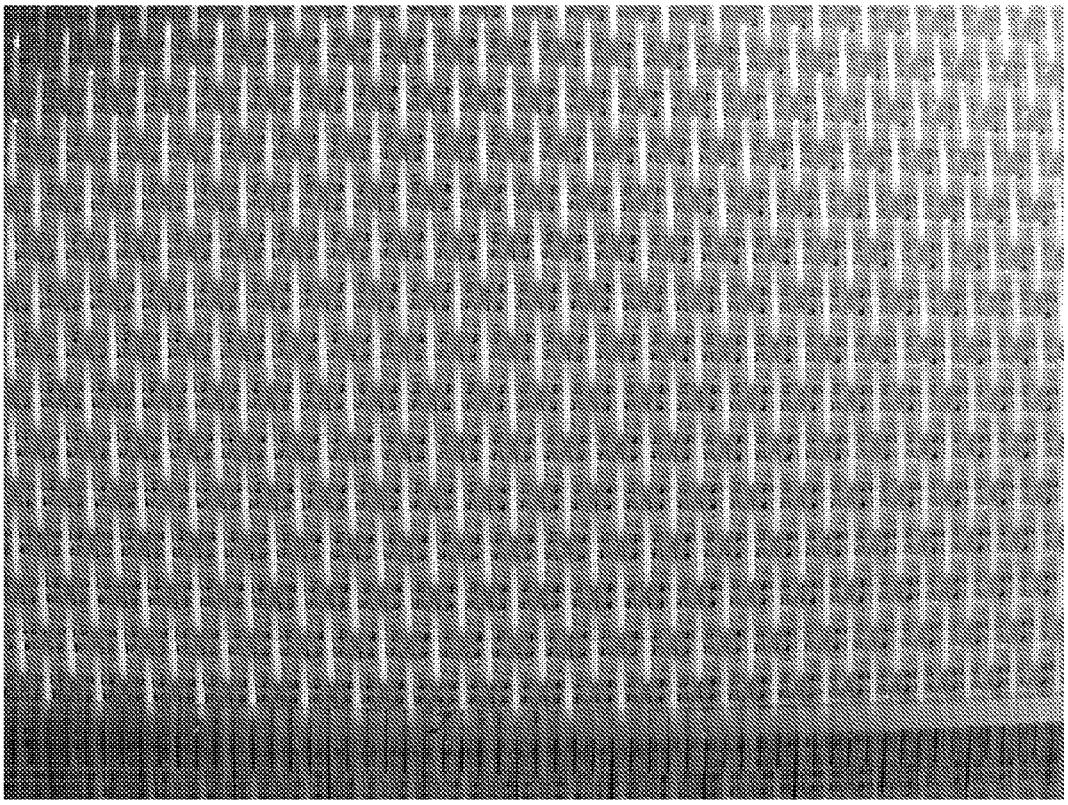
FIG. 2 is a photograph of the t-807-1 TAD fabric provided by Voith Fabrics (Appleton, Wis.).

For tissue webs produced by CTAD, the web was formed on a TissueForm V forming fabric, transferred to a Voith 2164 fabric and vacuum dewatered to roughly 25 percent consistency. The web was then transferred to a t-807-1 TAD fabric (illustrated in FIG. 2, Voith Fabrics, Appleton, Wis.). No rush transfer was utilized at the transfer to the t-807-1 TAD fabric. After the web was transferred to the t-807-1 TAD fabric, the web was dried, however the consistency was maintained low enough to allow significant molding when the web was transferred using high vacuum to a the impression fabric described as "Fred" in U.S. Pat. No. 7,611,607, which is incorporated herein in a manner consistent with the present disclosure. A vacuum level of at least 10 inches of mercury was used for the transfer to the impression fabric in order to mold the web as much as possible into the fabric. The web was then transferred to a Yankee dryer and creped. Minimum pressure was used at the web transfer to minimize compaction of the web during the transfer to the Yankee dryer so as to maintain maximum web caliper.

An adhesive formulation of polyvinyl alcohol, Kymene® and Rezosol was used for creping. The adhesive composition and add on rates were typical for standard creped throughdried tissue. The sheet was dried to a very high level (less than about 2 percent moisture) on the Yankee dryer to maximize bulk in the creping process. High web tension between the Yankee and the reel was maintained to prevent sheet wrinkling.

For the UCTAD tissue-making process, the web was formed on a TissueForm V forming fabric, vacuum dewatered to approximately 25 percent consistency and then subjected to 25 percent rush transfer when transferred to a high-topography fabric described as "Jetson" in U.S. Pat. No. 7,611,607. The web was then transferred to a high-topography TAD fabric, described as "Jack" in U.S. Pat. No. 7,611,607, using vacuum levels of at least about 14 inches of mercury at the transfer, and dried to approximately 98 percent solids before winding.

The post-tissue machine webs were then converted into various bath tissue rolls. In the converting process, the webs were crimped for ply attachment and care was taken not to create any web compression that might reduce web caliper. Rolls were converted to a target Kershaw firmness of about 6 to about 6.5 mm.

Three product forms were produced: (1) a two-ply UCTAD product from two uncreped throughdried webs, (2) a two-ply CTAD product from two creped throughdried webs, and (3) a two-ply hybrid UCTAD/CTAD product from a combination of one ply of uncreped throughdried and one ply of creped throughdried base sheet.

Table 1 shows the process conditions for each of the samples prepared in accordance with the present example. The amount of Baystrength 3000 strength additive added to the respective samples is expressed in Kg/MT based on the total furnish. In instances where Baystrength was added, the Baystrength was added to either the first, second or third layer, as specified below. For example, for code 5 the total addition was 2 kg/MT, and all the chemical was added to the center layer, thus making the addition based on that layer 6

Kg/MT. No Baystrength was added to the outer layers for this code, making the addition based on the three layers 0, 6 and 0 Kg/MT respectively.

TABLE 1

| Sample No. | Machine Mode | Basis Weight (gsm) | Refining Time (min) | Baystrength 3000 (kg/MT) | Baystrength Layer |
|---|---|---|---|---|---|
| 1 | UCTAD | 24 | — | — | — |
| 2 | UCTAD | 21 | — | — | — |
| 5 | UCTAD | 18 | — | 2 | 0/6/0 |
| 6 | UCTAD | 18 | — | 4 | 3/6/3 |
| 7 | UCTAD | 16 | — | — | — |
| 8 | UCTAD | 16 | — | 2 | 0/6/0 |
| 14 | CTAD | 18 | 2 | 2 | 0/6/0 |
| 16 | CTAD | 20 | | — | — |
| 17 | CTAD | 22 | 2 | — | — |
| 18 | CTAD | 24 | — | — | — |
| 19 | CTAD | 24 | — | 2 | 0/6/0 |
| 20 | CTAD | 22 | 2 | 2 | 0/6/0 |
| 21 | CTAD | 20 | 2 | 2 | 0/6/0 |
| 22 | UCTAD | 24 | — | 2 | 0/6/0 |
| 23 | UCTAD | 24 | — | 4 | 3/6/3 |
| 24 | UCTAD | 21 | — | 2 | 0/6/0 |
| 25 | UCTAD | 21 | — | 4 | 3/6/3 |
| 26 | UCTAD | 18 | — | 2 | 0/6/0 |
| 27 | UCTAD | 18 | — | 2 | 0/6/0 |
| 28 | UCTAD | 18 | — | 4 | 3/6/3 |
| 29 | UCTAD | 16 | — | 2 | 0/6/0 |
| 30 | UCTAD | 16 | — | 4 | 3/6/3 |
| 31 | UCTAD | 16 | — | — | — |
| 32 | UCTAD | 16 | — | 3 | 0/6/0 |
| 34 | UCTAD | 18 | — | 2 | 0/6/0 |

Table 2 summarizes the physical properties of the basesheet webs prepared as described above.

TABLE 2

| Sample No. | BW (gsm) | GMT (gf) | MDT (gf) | MDS (%) | MD Slope (gf) | MD TEA (gf*cm/cm$^2$) | CDT (gf) | CDS (%) | CD Slope (gf) | CD TEA (gf*cm/cm$^2$) | Caliper (mm) |
|---|---|---|---|---|---|---|---|---|---|---|---|
| 1 | 24 | 935 | 1250 | 19.54 | 5798 | 15.91 | 700 | 16.16 | 2460 | 5.95 | 29.20 |
| 2 | 21 | 736 | 973 | 18.73 | 4430 | 11.75 | 557 | 14.20 | 2664 | 4.38 | 27.45 |
| 5 | 18 | 826 | 1068 | 20.81 | 4645 | 14.21 | 640 | 15.54 | 2448 | 5.33 | 24.80 |
| 6 | 18 | 850 | 1092 | 19.90 | 4684 | 13.83 | 662 | 15.11 | 2681 | 5.42 | 28.00 |
| 7 | 16 | 446 | 592 | 17.22 | 3503 | 7.00 | 336 | 12.40 | 2640 | 2.59 | 24.20 |
| 8 | 16 | 670 | 854 | 19.60 | 4162 | 10.99 | 525 | 13.85 | 2756 | 4.08 | 25.75 |
| 14 | 18 | 1315 | 1828 | 28.98 | 4628 | 22.94 | 946 | 9.16 | 9349 | 6.23 | 11.30 |
| 16 | 20 | 886 | 1183 | 28.78 | 2879 | 15.86 | 665 | 9.27 | 7812 | 4.69 | 12.60 |
| 17 | 22 | 1090 | 1517 | 30.41 | 2735 | 19.00 | 783 | 9.34 | 8101 | 5.35 | 13.50 |
| 18 | 24 | 630 | 851 | 30.16 | 2317 | 13.95 | 467 | 10.43 | 5087 | 3.87 | 14.40 |
| 19 | 24 | 845 | 1192 | 28.19 | 2718 | 15.63 | 599 | 9.75 | 6150 | 4.31 | 13.20 |
| 20 | 22 | 1606 | 2272 | 31.56 | 4391 | 30.45 | 1135 | 9.57 | 10411 | 7.76 | 13.35 |
| 21 | 20 | 1141 | 1505 | 27.02 | 4602 | 19.40 | 866 | 9.56 | 8419 | 6.04 | 12.00 |
| 22 | 24 | 1188 | 1708 | 22.43 | 5870 | 23.39 | 827 | 17.65 | 2433 | 7.57 | 30.30 |
| 23 | 24 | 1639 | 2042 | 20.45 | 8470 | 27.37 | 1316 | 16.16 | 3330 | 10.53 | 30.05 |
| 24 | 21 | 1127 | 1409 | 19.52 | 6435 | 18.27 | 902 | 15.41 | 2826 | 7.00 | 28.65 |
| 25 | 21 | 1390 | 1693 | 20.19 | 7217 | 22.68 | 1142 | 15.97 | 3082 | 9.02 | 28.10 |
| 26 | 18 | 1187 | 1426 | 19.03 | 6765 | 18.23 | 988 | 15.30 | 2824 | 7.25 | 28.15 |
| 27 | 18 | 1311 | 1608 | 19.52 | 6893 | 20.77 | 1070 | 15.55 | 2805 | 7.77 | 28.20 |
| 28 | 18 | 1600 | 1972 | 21.38 | 7578 | 26.92 | 1298 | 16.19 | 2946 | 9.78 | 27.60 |
| 29 | 16 | 1215 | 1430 | 19.44 | 6889 | 19.18 | 1032 | 16.28 | 2522 | 7.61 | 29.15 |
| 30 | 16 | 1517 | 1786 | 20.54 | 8218 | 24.38 | 1289 | 16.86 | 2668 | 9.68 | 29.30 |
| 31 | 16 | 903 | 1037 | 29.97 | 2214 | 15.01 | 788 | 8.82 | 7155 | 4.86 | 13.35 |
| 32 | 16 | 1290 | 1558 | 30.55 | 3167 | 21.96 | 1068 | 9.14 | 8845 | 6.50 | 13.35 |
| 34 | 18 | 1273 | 1610 | 30.54 | 3721 | 23.41 | 1007 | 9.90 | 7639 | 6.64 | 13.55 |

Table 3, below, shows the physical properties of rolled tissue products produced from the basesheet webs described above. Note that all rolled products comprised two plies of basesheet such that rolled product sample 1 comprised two plies of basesheet sample 1, as specified above, rolled sample 2 comprised two plies of basesheet sample 2, as specified above, and so forth.

TABLE 3

| Sample No. | BW (gsm) | Bulk (cc/g) | Kershaw Firmness (mm) | Absorbency (g/g) | GMT (gf) | CDS (%) | Burst (g) |
|---|---|---|---|---|---|---|---|
| Roll 1 | 48 | 16.4 | 7.2 | 12.93 | 638 | 10.8 | 712 |
| Roll 2 | 42 | 19.1 | 8.7 | 13.96 | 633 | 12.2 | 692 |
| Roll 5 | 36 | 21.3 | 8.2 | 16.38 | 651 | 11.8 | 686 |
| Roll 6 | 36 | 21.1 | 8.3 | 17.17 | 709 | 12.2 | 754 |
| Roll 7 | 32 | 18.9 | 9.8 | 15.37 | 356 | 9.6 | 392 |
| Roll 8 | 32 | 22.6 | 9.5 | 16.90 | 518 | 10.1 | 593 |
| Roll 14 | 36 | 11.4 | 3.4 | 13.57 | 1177 | 8.2 | 871 |
| Roll 16 | 40 | 10.5 | 3.3 | 12.59 | 794 | 8.7 | 672 |
| Roll 17 | 44 | 9.9 | 2.8 | 11.96 | 1007 | 7.1 | 699 |
| Roll 18 | 48 | 9.8 | 3.6 | 11.98 | 518 | 7.8 | 565 |
| Roll 19 | 48 | 10.1 | 3.5 | 12.05 | 789 | 8.3 | 689 |
| Roll 20 | 44 | 10.4 | 3.5 | 12.05 | 1327 | 8.3 | 929 |
| Roll 21 | 40 | 11.5 | 3.6 | 12.9 | 1113 | 8.3 | 815 |
| Roll 22 | 48 | 16.4 | 7.5 | 12.52 | 859 | 13.67 | 881 |
| Roll 23 | 48 | 18.3 | 7.0 | 13.01 | 1212 | 11.97 | 1138 |
| Roll 24 | 42 | 17.7 | 7.5 | 13.73 | 785 | 10.98 | 867 |
| Roll 25 | 42 | 19.4 | 7.5 | 13.44 | 989 | 12.28 | 927 |
| Roll 26 | 36 | 21.7 | 9.8 | 14.69 | 880 | 10.48 | 865 |
| Roll 27 | 36 | 21.2 | 7.9 | 15.57 | 945 | 13.23 | 1104 |
| Roll 28 | 36 | 21.9 | 6.7 | 15.82 | 1138 | 12.75 | 1247 |
| Roll 29 | 32 | 25.0 | 8.1 | 17.55 | 938 | 14.05 | 1133 |
| Roll 30 | 32 | 25.0 | 9.0 | 17.34 | 1163 | 14.55 | 1246 |
| Roll 31 | 32 | 13.2 | 7.9 | 13.0 | 674 | 7.48 | 872 |
| Roll 32 | 32 | 12.4 | 6.4 | 13.57 | 973 | 8.43 | 790 |
| Roll 34 | 36 | 11.9 | 6.6 | 13.35 | 976 | 9.4 | 735 |

The comparable product parameters for current commercial TAD bath tissues are shown in tables 4 and 5. As indicated in the tables, these commercial products exhibit a wide range of properties, including wide ranges of basis weight, bulk, strength and stretch properties. Table 4 shows the TAD products offered for sale by Proctor & Gamble under the trade name Charmin, including 4 variants of the Charmin Ultra Soft® product and 4 variants of the Charmin Ultra Strong® product. Also included is the new (2011) Ultra Soft® product, introduced in early 2011.

TABLE 4

| Commercial Product | BW (gsm) | Roll Bulk (cc/g) | Kershaw Firmness (mm) | Absorbency (g/g) | GMT (gf) | CDS (%) | Burst (g) |
|---|---|---|---|---|---|---|---|
| Charmin ® Ultra Soft (regular roll) | 46.9 | 12.5 | 6.1 | 13.7 | 766 | 10.3 | 841 |
| Charmin ® Ultra Soft (big roll) | 45.2 | 10.4 | 5.8 | 12.6 | 788 | 9.7 | 870 |
| Charmin ® Ultra Soft (giant roll) | 45.3 | 8.9 | 6.3 | 13.1 | 771 | 10.0 | 862 |
| Charmin ® Ultra Soft (mega roll) | 44.4 | 7.8 | 4.8 | 11.3 | 846 | 8.5 | 888 |
| Charmin ® Ultra Soft 2011 (regular roll) | 44.8 | 10.2 | 5.8 | 12.3 | 916 | 5.5 | 882 |
| Charmin ® Ultra Strong (regular roll) | 38.2 | 16.0 | 5.8 | 15.5 | 1285 | 12.1 | 1606 |
| Charmin ® Ultra Strong (big roll) | 36.9 | 13.2 | 7.6 | 14.2 | 1157 | 9.7 | 1266 |
| Charmin ® Ultra Strong (giant roll) | 37.1 | 12.8 | 6.7 | 14.9 | 1232 | 10.3 | 1429 |
| Charmin ® Ultra Strong (mega roll) | 36.3 | 10.8 | 7.3 | 13.3 | 1172 | 10.4 | 1298 |

Table 5 shows the 2-ply Kimberly-Clark throughdried bath products in the market. Again, there are a variety of products ranging from regular roll at higher bulk to Mega roll at lower bulk.

TABLE 5

| Commercial Product | BW (gsm) | Roll Bulk (cc/g) | Kershaw Firmness (mm) | Absorbency (g/g) | GMT (gf) | CDS (%) | Burst (g) |
|---|---|---|---|---|---|---|---|
| Cottonelle Ultra ® Big Roll | 44.0 | 14.5 | 9.4 | — | 1021 | 18.7 | — |
| Cottonelle Ultra ® Double Roll | 43.26 | 14.0 | 7.1 | 15.9 | 1002 | 17.9 | 1048 |
| Cottonelle Ultra ® Triple Roll | 43.38 | 9.3 | 6.0 | — | 868 | 19.1 | — |

Comparing the inventive samples to the commercial samples from tables 4 and 5, the highest commercial roll bulk is 16 cc/g obtained from the Charmin Ultra Strong regular roll product which has a basis weight of approximately 38 gsm. For the higher basis weight product, the highest bulk achieved is 12.5 cc/g for the 47 gsm Charmin Ultra Soft regular roll code.

In addition to the above described rolled tissue products, additional inventive rolled tissue products were produced by plying one tissue web produced using UCTAD to a tissue web produced using CTAD. Basesheets for use in the rolled products were prepared as described in Table 6, below.

TABLE 6

| Sample No. | Machine Mode | Basis Weight (gsm) | Refining Time (min) | Baystrength 3000 (kg/MT) | Baystrength Layer |
|---|---|---|---|---|---|
| 52 | UCTAD | 22 | — | — | — |
| 53 | UCTAD | 22 | — | 2 | 0/6/0 |
| 54 | UCTAD | 22 | — | 4 | 3/6/3 |
| 55 | UCTAD | 18 | — | 1 | 0/3/0 |
| 56 | UCTAD | 18 | — | 1 | 0/3/0 |
| 58 | UCTAD | 22 | — | 2 | 0/6/0 |
| 59 | CTAD | 18 | — | 3 | 0/9/0 |
| 60 | CTAD | 22 | 1 | 2 | 0/6/0 |
| 61 | CTAD | 22 | 2 | 2.5 | 0/7.5/0 |
| 61B | CTAD | 22 | 2 | — | — |

TABLE 6-continued

| Sample No. | Machine Mode | Basis Weight (gsm) | Refining Time (min) | Baystrength 3000 (kg/MT) | Baystrength Layer |
|---|---|---|---|---|---|
| 62 | CTAD | 22 | 2 | — | — |
| 64 | CTAD | 18 | 3 | — | — |
| 64B | CTAD | 18 | 3 | 1.5 | 0/4.5/0 |
| 65 | CTAD | 18 | 3 | 3 | 0/9/0 |

Table 7 summarizes the physical properties of the basesheet webs prepared as described above.

TABLE 7

| Sample No. | GMT (gf) | MDT (gf) | MDS (%) | MD Slope (gf) | MDTEA (gf*cm/cm$^2$) |
|---|---|---|---|---|---|
| 52 | 791 | 1144 | 17.66 | 4925 | 13.17 |
| 53 | 1105 | 1651 | 19.39 | 6353 | 20.28 |
| 54 | 1282 | 1936 | 20.30 | 7127 | 24.78 |
| 55 | 819 | 1191 | 17.62 | 5134 | 13.77 |
| 56 | 1018 | 1473 | 18.57 | 5893 | 17.46 |
| 58 | 936 | 1353 | 17.59 | 5801 | 15.70 |
| 59 | 1129 | 1623 | 18.56 | 6792 | 19.76 |
| 60 | 850 | 1292 | 30.41 | 3550 | 22.30 |
| 61 | 1482 | 2073 | 32.18 | 3487 | 30.78 |
| 61B | 1109 | 1521 | 33.70 | 3132 | 26.53 |
| 62 | 997 | 1306 | 32.72 | 3247 | 24.14 |
| 64 | 842 | 1115 | 33.34 | 2713 | 19.62 |

TABLE 7-continued

| Sample No. | GMT (gf) | MDT (gf) | MDS (%) | MD Slope (gf) | MDTEA (gf*cm/cm$^2$) |
|---|---|---|---|---|---|
| 64B | 918 | 1256 | 33.54 | 2688 | 20.62 |
| 65 | 1128 | 1548 | 32.95 | 2809 | 22.92 |

The post-tissue machine webs were then converted into various bath tissue rolls. In the converting process, the webs were crimped for ply attachment and care was taken not to create any web compression that might reduce web caliper. Rolls were converted to a target Kershaw firmness of about 6 to about 6.5 mm. Table 8, below, shows the physical properties of rolled tissue products produced in this manner. Note that all rolled products comprised two plies of basesheet such that rolled product sample 18-1 comprised two plies, the first being basesheet sample 18, as specified above, and the second being basesheet sample 1, as specified above, and so forth.

TABLE 8

| Sample No. | BW (gsm) | Bulk (cc/g) | Kershaw Firmness (mm) | Absorbency (g/g) | GMT (gf) | CDS (%) | Burst (g) |
|---|---|---|---|---|---|---|---|
| Roll 18-1 | 48.0 | 16.3 | 5.7 | 13.14 | 548 | 12.3 | 686 |
| Roll 52-60 | 40.6 | 19.9 | 7.8 | 14.15 | 471 | 11.2 | 716 |
| Roll 53-61B | 41.3 | 20.1 | 7.7 | 15.13 | 638 | 10.2 | 916 |
| Roll 54-61 | 41.7 | 20.9 | 7.3 | 15.38 | 810 | 9.0 | 1027 |
| Roll 56-62 | 41.9 | 19.2 | 6.5 | 13.41 | 622 | 8.7 | 854 |
| Roll 55-64 | 33.6 | 23.1 | 7.6 | 16.15 | 515 | 8.6 | 662 |
| Roll 58-64B | 33.0 | 23.7 | 8.0 | 15.73 | 550 | 11.0 | 743 |
| Roll 59-65 | 33.6 | 25.9 | 8.9 | 16.57 | 641 | 9.7 | 811 |

The surface and shear properties of certain webs, prepared as described above, were also evaluated using the KES Surface Tester (model KES-SE) and KES Tensile & Shear Tester (model KES-FB1) as described in the Test Methods Section. The results of the surface analysis are summarized in Table 9, below.

TABLE 9

| Sample No. | Shear Hysteresis (gf/cm) | Surface Smoothness (MIU) multi-wire probe | Mean Deviation of MIU (MMD) multi-wire probe | Shear Rigidity (gf/cm degree) |
|---|---|---|---|---|
| 14 | 2.75 | 0.158 | 0.0131 | 4.58 |
| 16 | 2.72 | 0.162 | 0.0113 | 3.84 |
| 17 | 2.99 | 0.159 | 0.0111 | 4.22 |
| 18 | 3.28 | 0.168 | 0.0085 | 3.87 |
| 19 | 2.74 | 0.168 | 0.0098 | 3.86 |
| 20 | 2.89 | 0.159 | 0.0131 | 4.63 |
| 21 | 2.67 | 0.161 | 0.0128 | 4.39 |
| Roll 52-60 | 2.73 | 0.183 | 0.0133 | 3.43 |
| Roll 53-61B | 3.10 | 0.165 | 0.0139 | 3.76 |
| Roll 54-61 | 3.11 | 0.240 | 0.0137 | 3.92 |
| Roll 56-62 | 3.01 | 0.258 | 0.0185 | 3.35 |
| Roll 55-64 | 2.90 | 0.175 | 0.0141 | 3.28 |
| Roll 58-64B | 2.83 | 0.159 | 0.0119 | 4.13 |
| Roll 59-65 | 2.76 | 0.175 | 0.0160 | 3.59 |
| Cottonelle ® Double Roll @ 10 cc/g roll bulk | 3.58 | 0.151 | 0.0102 | 3.51 |

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present disclosure should be assessed as that of the appended claims and any equivalents thereto.

We claim:

1. A rolled tissue product comprising a multi-ply tissue web spirally wound into a roll, the tissue web having a basis weight less than about 40 gsm and an Absorbency greater than about 17 grams per gram.

2. The rolled tissue product of claim 1 wherein the tissue web has a geometric mean tensile (GMT) from about 900 to about 1300 grams per three inches.

3. The rolled tissue product of claim 1 wherein the tissue web has cross-machine direction stretch (CD Stretch) greater than about 10 percent.

4. The rolled tissue product of claim 1 wherein the tissue web has CD Stretch from about 10 to about 15 percent.

5. The rolled tissue product of claim 1 wherein the tissue web has Burst Strength greater than about 1000 grams.

6. The rolled tissue product of claim 1 wherein the spirally wound roll has a Roll Bulk greater than about 15 cc/g.

7. The rolled tissue product of claim 1 wherein the spirally wound roll has a Roll Bulk greater than about 18 cc/g and a Kershaw Firmness less than about 9.0 mm.

8. A rolled tissue product comprising a multi-ply tissue web spirally wound into a roll, the spirally wound roll having a Kershaw Firmness less than about 5.0 mm and a Roll Bulk greater than about 10 cc/g, and the tissue web having a basis weight greater than about 40 gsm.

9. The rolled tissue product of claim 8 wherein the tissue web has a geometric mean tensile (GMT) from about 900 to about 1300 grams per three inches.

10. The rolled tissue product of claim 8 wherein the spirally wound roll has a Roll Bulk from about 10 to about 12 cc/g and a Kershaw Firmness from about 3.0 to about 5.0 mm.

11. The rolled tissue product of claim 8 wherein the tissue web has a basis weight from about 32 to about 40 gsm.

12. A rolled tissue product comprising a multi-ply tissue web spirally wound into a roll, the multi-ply tissue web comprising at least a first ply and a second ply, wherein the first ply is a creped through air dried web, the multi-ply tissue web having a basis weight from about 40 to about 48 gsm and a CD Stretch greater than about 11 percent, the wound roll having a Roll Bulk greater than about 16 cc/g.

13. The rolled tissue product of claim 12 wherein the spirally wound roll has a Roll Bulk from about 16 to about 20 cc/g.

14. The rolled tissue product of claim 12 wherein the spirally wound roll has a Roll Bulk from about 16 to about 20 cc/g and a Kershaw Firmness from about 7.0 to about 9.0 mm.

15. The rolled tissue product of claim 12 wherein the tissue web has an Absorbency from about 13 to about 15 grams per gram.

16. A rolled tissue product comprising a multi-ply tissue web spirally wound into a roll, the multi-ply tissue web comprising at least a first ply and a second ply, wherein the first ply is a creped through air dried web, the multi-ply tissue web having a basis weight less than about 40 gsm, the wound roll having a Roll Bulk greater than about 18 cc/g.

17. The rolled tissue product of claim 16 wherein the spirally wound roll has a Roll Bulk from about 18 to about 26 cc/g.

18. The rolled tissue product of claim 16 wherein the spirally wound roll has a Roll Bulk from about 18 to about 26 cc/g and a Kershaw Firmness from about 7.0 to about 9.0 mm.

19. The rolled tissue product of claim 16 wherein the tissue web has a CD Stretch from about 8 to about 12 percent.

20. The rolled tissue product of claim 16 wherein the tissue web has a basis weight from about 33 to about 35 gsm.

* * * * *